US007316064B2

(12) United States Patent
Chou et al.

(10) Patent No.: US 7,316,064 B2
(45) Date of Patent: Jan. 8, 2008

(54) INDUCTION REFLOW APPARATUS AND METHOD OF USING THE SAME

(75) Inventors: George Jyh-Shann Chou, Mechanicsburg, PA (US); Robert Daniel Hilty, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 189 days.

(21) Appl. No.: 11/213,496

(22) Filed: Aug. 26, 2005

(65) Prior Publication Data

US 2007/0045124 A1 Mar. 1, 2007

(51) Int. Cl.
*H01R 43/00* (2006.01)

(52) U.S. Cl. ..... 29/884; 29/874; 29/876; 29/879

(58) Field of Classification Search ..... 29/874, 29/876, 879, 884, 825
See application file for complete search history.

(56) References Cited

U.S. PATENT DOCUMENTS

| | | | | |
|---|---|---|---|---|
| 5,032,703 | A * | 7/1991 | Henschen et al. | 219/85.22 |
| 5,111,991 | A | 5/1992 | Clawson et al. | |
| 5,519,192 | A * | 5/1996 | Childs et al. | 219/616 |
| 5,672,891 | A * | 9/1997 | Hamamoto et al. | 257/301 |
| 5,675,891 | A | 10/1997 | Childs et al. | |
| 2001/0001464 | A1 | 5/2001 | Godwin | |

FOREIGN PATENT DOCUMENTS

| | | |
|---|---|---|
| DE | 195 29 928 A1 | 2/1997 |
| TW | 0495945 B | 7/2002 |

* cited by examiner

*Primary Examiner*—Carl J. Arbes

(57) ABSTRACT

A method for manufacturing an electrical contact includes providing a series of electrical contacts joined on a carrier strip to a plating station followed by an induction heating station. At the plating station, plating the electrical contacts with a conductive alloy coating to form coated electrical contacts. At the induction heating station, induction heating the coated electrical contacts.

18 Claims, 4 Drawing Sheets

INDUCTION REFLOW APPARATUS AND METHOD OF USING THE SAME

BACKGROUND OF THE INVENTION

This invention relates generally to manufacturing methods and apparatus for electrical contacts, and more particularly, to methods and apparatus for induction heating electrical contacts.

Electrical and electronic devices generally include circuitry and components which are electrically connected to operate the devices. Typically, the circuitry includes electrical contacts that are mechanically attached, surface mounted and/or soldered to a circuit board. A substrate material of each of the electrical contacts is generally coated with a conductive alloy coating to enhance the soldering characteristics of the electrical contacts. Tin and tin alloy coatings have been used to coat the substrate materials due to the low cost, anti-corrosion, and solderability properties of the tin and tin alloy coatings.

However, the tin and tin alloy coatings have the problems of tin whisker growth and poor solderability due to reactions between the tin and the substrate material. To overcome the problems of tin whiskering and poor solderability, the tin coating is heated until the tin is reflowed. The benefits of the reflowed tin result from microstructure changes and stress relief in the coating and substrate material.

One conventional process used to reflow the tin coating involves the use of a reflow oven to heat the electrical contact and the tin coating. One type of reflow oven is a convection oven. Anther type of reflow oven is an infrared heating oven. However, the problem with the reflow oven is that the entire electrical contact is heated and the process is relatively slow to induce the reflow of the tin. Additionally, once the contacts are removed from the oven, the contacts are shaped, stamped and/or trimmed to a final form, thus exposing the substrate material on areas of the contact such as the edges. The exposed substrate causes solderability problems during assembly of the electrical device. Moreover, convection reflow ovens are also used to melt the tin plating on the contacts, but the time required to heat the contacts causes the tin plating to flow around the contact. As a result, the tin plating thickness may be modified and the overall product performance may be affected.

Another conventional process used to reflow the tin coating involves the use of an induction heater to heat the substrate and the tin coating. The process involves supplying a stock of material pre-coated with tin to the induction heater. Once the tin is reflowed, the stock is shaped. However, during the shaping process, the substrate material is exposed from the shearing and bending process. The exposed substrate causes solderability problems during assembly of the electrical device. As a result, the electrical contacts manufactured in the conventional induction heating processes are not suitable in soldering applications.

BRIEF DESCRIPTION OF THE INVENTION

In one aspect, a method for manufacturing an electrical contact is provided. The method includes providing a series of electrical contacts joined on a carrier strip to a plating station followed by an induction heating station. At the plating station, plating the electrical contacts with a conductive alloy coating to form coated electrical contacts. At the induction heating station, induction heating the coated electrical contacts.

Optionally, the method may include stamping a sheet stock into blanked electrical contacts joined on a carrier strip, wherein the stamping comprises removing a portion of the stock, and forming the blanked electrical contacts into formed electrical contacts joined on a carrier strip. The formed electrical contacts may have a shape configured for end use. The method may also include controlling the temperature of the coated electrical contacts at the induction heating station by adjusting the speed which the coated electrical contacts are provided to the induction heating station. The temperature of the coated electrical contacts may be controlled at the induction heating station by adjusting one of an operating frequency and an operating power of an induction heater.

In another aspect, a method of preparing an electrical contact for induction heating is provided. The method includes providing a series of blanked electrical contacts joined on a carrier strip to a forming station followed by a plating station. At the forming station, forming the blanked electrical contacts into formed electrical contacts joined on a carrier strip, wherein the formed electrical contacts have a shape configured for end use. At the plating station, plating the formed electrical contacts with a conductive alloy coating to form coated electrical contacts.

DETAILED DESCRIPTION OF THE INVENTION

Figure 1:
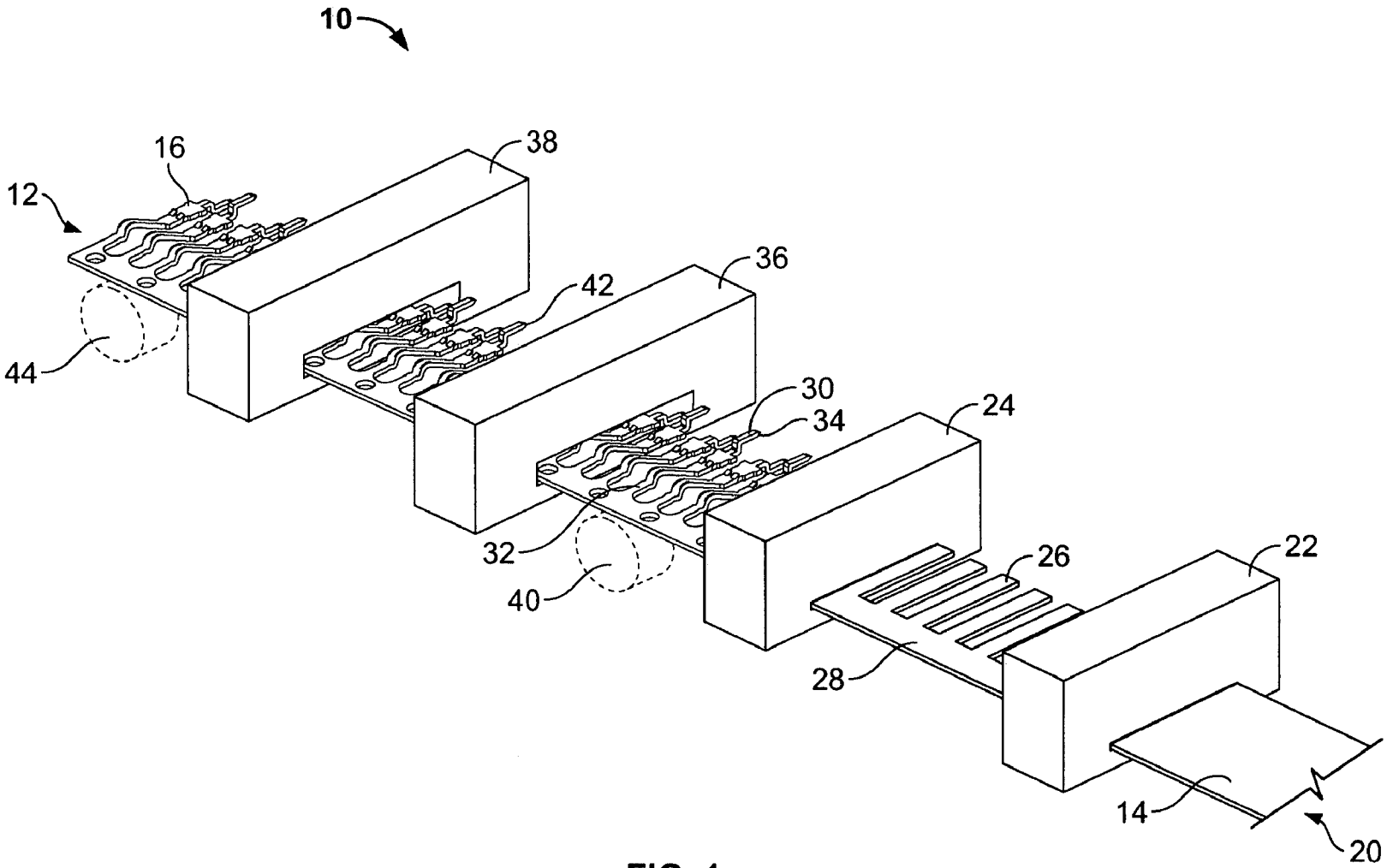
FIG. 1 is a schematic view of a machine used to manufacture an item in accordance with an exemplary embodiment of the present invention.

FIG. 1 is a schematic view of a machine 10 used to manufacture an item 12 in accordance with an exemplary embodiment of the present invention. The item 12 is fabricated from a conductive material (e.g. copper, aluminum, steel, or the like). The item 12 is transformed or otherwise manipulated by the machine 10 or machine components from a stock material 14 (e.g. a copper sheet) to an end-usable product 16 (e.g. an electrical contact). The stock material 14 is generally a planar body of conductive material having predefined width, length and thickness dimensions.

The machine 10 includes a conveyance system 20 for conveying or transferring the item 12 through the machine 10. The machine 10 is configured to shape the item 12, and the shaping step is an initial process in the fabrication of the item 12. In one embodiment, the machine 10 includes a stamping station 22 and a forming station 24 to facilitate the shaping of the item 12. The stock material 14 is supplied to the stamping station 22 and the stock material 14 is pressed, blanked or machined into blanked electrical contacts 26. For example, a portion of the stock material 14 is removed such that the blanked electrical contacts 26 are interconnected along a carrier strip 28 in a series. During the stamping process, a portion of the stock material 14 is subject to shear forces.

The blanked electrical contacts 26 are then conveyed to the forming station 24. At the forming station 24, the blanked electrical contacts 26 are formed or shaped into formed electrical contacts 30. The formed electrical contacts 30 have a predetermined shape. For example, the formed electrical contacts 30 may be curved or flexed into a certain non-planar pattern. The forming station 24 may involve a pressing process using dies and a pressing machine to provide the curved or flexed pattern. Alternatively, the forming station 24 may involve a crimping process to provide the non-planar pattern. Once formed, the formed electrical contacts 30 extend between a base 32 and a tip 34. Each base 32 is connected to the carrier strip 28 such that each formed electrical contact 30 is interconnected. Alternatively, rather than providing stamped and formed electrical contacts, the shaping process may involve a molding or casting station and process to provide the formed electrical contacts 30.

The shaping process provides formed electrical contacts 30 having a substantially similar shape as the end-usable products 16. The formed electrical contacts 30 are then conveyed or otherwise provided to a plating station 36 and then an induction heating station 38. Further shaping and forming is not required after the formed electrical contacts 30 are provided to the plating station 36 and the induction heating station 38. Optionally, the formed electrical contacts 30 are wound onto a reel 40 prior to being conveyed to the plating station 36. Alternatively, the reel 40 may be positioned downstream of the plating station 36 and the contacts 30 may be wound onto the reel 40 after the contacts are conveyed to the plating station 36 but before the contacts 30 are conveyed to the induction heating station 38. As a result, the shaping process and/or the plating process may be performed separate from the induction heating process. For example, each of the processes may be performed using different machines 10, and the reels 40 of electrical contacts 30 may be provided to the plating station 36 or induction heating station 38 as needed. Alternatively, the electrical contacts 30 are conveyed directly from the forming station 24 to the plating station 36 and then to the induction heating station.

At the plating station 36, the formed electrical contacts 30 are plated or coated with a conductive alloy coating (e.g. a tin or tin alloy) to form coated electrical contacts 42. Because the electrical contacts 42 are formed and shaped prior to plating at the plating station 36, the plating or coating is less susceptible to being damaged or removed. For example, bending or shearing forces imparted on the item 12, and particularly the coating on the item 12, causes at least a portion of the coating to weaken or flake, thus exposing the underlayer of stock material 14. The exposure of the underlayer causes solderability problems due to corrosion of the stock material 14 during the soldering application. One area particularly susceptible to this weakening or flaking of the stock material 14 is the edges of the item 12. By reducing or substantially eliminating any bending or manipulating of the shape of the electrical contacts 42 after plating at the plating station 36, but before heat treating at the induction heating station 38, the weakening of the conductive alloy coating is substantially eliminated. In one embodiment, the conductive alloy coating is a tin or tin alloy coating. Alternatively, the conductive alloy coating is a gold or gold alloy coating. However, other coatings may also be used. The coating on the electrical contacts 42 facilitates enhancing the soldering and electrical characteristics of the electrical contacts 42. The conductive alloy coating is applied through a plating process. Alternatively, the conductive alloy coating may be applied through a dipping process, a spraying process, or the like. In one embodiment, the entire formed electrical contact 30 is coated. Alternatively, the formed electrical contact 30 may be coated in pre-selected areas. After coating, the coated electrical contacts 42 are transferred to the induction heating station 38.

At the induction heating station 38, the coated electrical contacts 42 are heat treated through an induction heating process. The induction heating process causes the conductive alloy coating to melt and reflow, thus relieving internal stresses in the coating. As a result, the risk of whisker growth in the coating during storage and use of the end-usable product 16 is substantially reduced. Additionally, the induction heating process may cause a reaction between the conductive coating and the substrate metal underlying the conductive coating. The reaction may include the formation of intermetallic compounds which increase the effective hardness of the coating and further reduce whiskering tendencies. Additionally, the reaction may cause the metals to achieve higher levels of stress-resistance to surface deformation, which also relieves internal stresses and whiskering. Once the electrical contacts 42 are heat treated at the induction heating station 38, the electrical contacts 42 are in an end-usable form. Optionally, the electrical contacts 42 may be cooled or cured after being heat treated. The electrical contacts 42 may also be wound on a reel 44 for storing or transporting the formed, coated, and treated electrical contacts 42. In one embodiment, the formed electrical contacts 30 are coated with at least two different types of coatings. Each coating has a different melting temperature, and the reflow of the coatings may be controlled at the induction heating station 38. For example, the contacts 30 may be coated with a tin based coating and a gold based coating. At the induction heating station 38, the tin based coating may be reflowed and the gold based coating may be unchanged by adjusting the coil design, processing speed, and processing power of the induction heating station 38.

Figure 2:
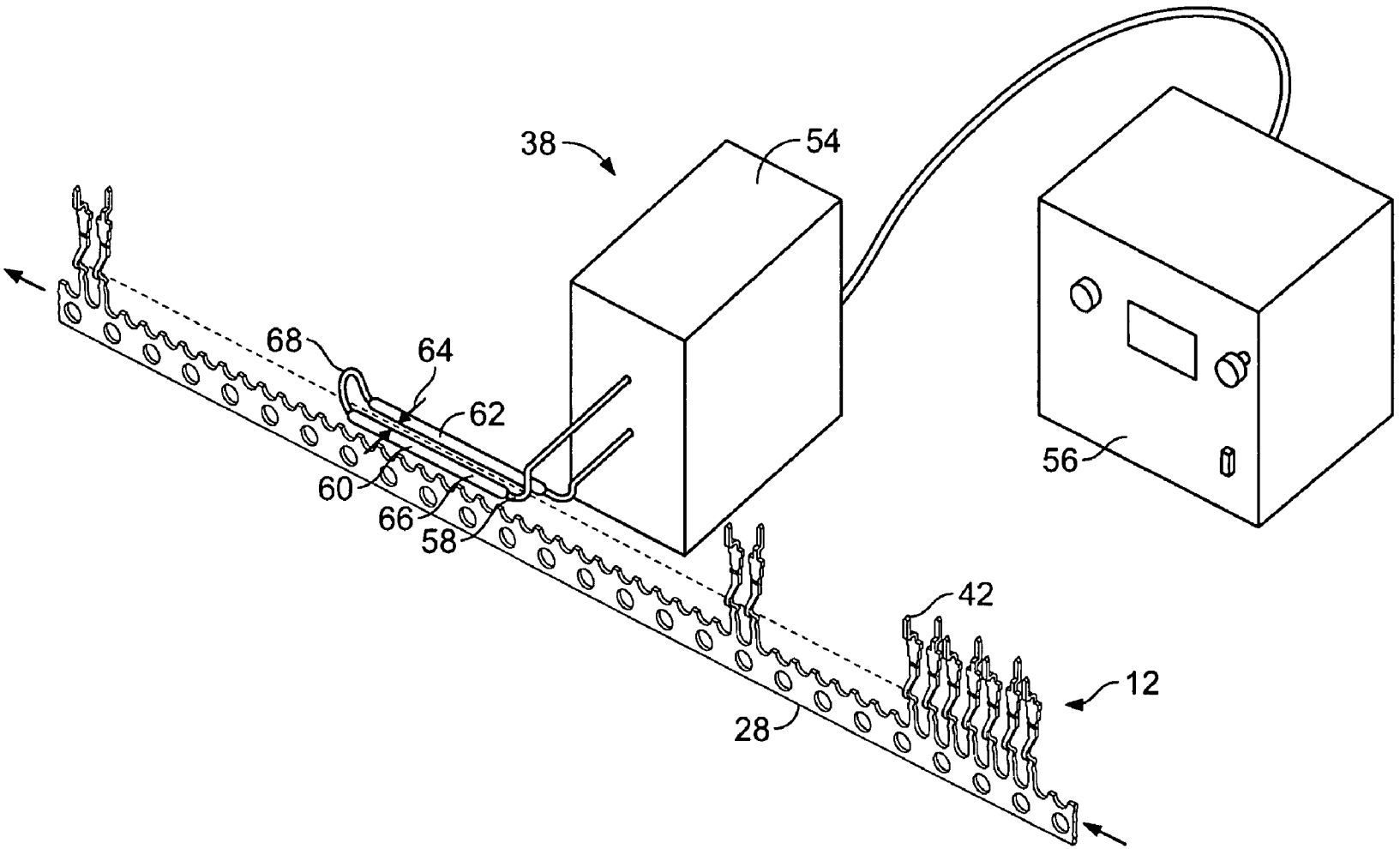
FIG. 2 is a perspective view of an induction heating station for use in manufacturing the item shown in FIG. 1.

FIG. 2 is a perspective view of the induction heating station or system 38 for use in manufacturing the item 12 in accordance with an exemplary embodiment of the present invention. As indicated above, the induction heating station 38 represents one station or manufacturing step within a series of manufacturing steps. Other manufacturing steps may be performed prior to the induction heating step, e.g., stamping, shaping or otherwise forming the item, or plating the item to set up the item for the induction heating step. Additionally, other manufacturing steps may be performed after the induction heating step, e.g., cooling or winding the item for packaging or transportation.

The induction heating station 38 includes an induction heater 54 connected to a power supply device 56. The induction heater 54 includes a tube or coil 58 extending therefrom. The tube 58 is manufactured from a copper material. Alternatively, the tube 58 may be manufactured from another conductive material. The tube 58 extends along an induction heating path, and when using the induction heating station 38, the item 12 is directed along the induction heating path. The induction heating path is defined by, and positioned between, a first portion 60 and a second portion 62 of the tube 58. The first and second portions 60 and 62 extend parallel to, and are spaced apart from, one another by a distance 64. The distance 64 is selected such that the item 12 is heated when brought into close proximity of the tube 58. Additionally, the distance 64 is selected such that the item 12 does not contact either of the first and second portions 60 and 62 as the item 12 is conveyed through the induction heating station 38. Optionally, the tube 58, particularly at the first and second portions 60 and 62, includes a protective sleeve 66. The protective sleeve 66 is fabricated from a dielectric material, such as a polytetrafluoroethylene material. The protective sleeve 66 protects the tube 58 and the item 12 from inadvertent contact with one another. Alternatively, a guidance system may be provided to guide the contacts 42 along the induction heating path. The first and second portions 58 and 60 are joined to one another at an outer end 68. The outer end 68 is inclined or elevated away from the induction heating path such that the items 12 may be conveyed downstream of the induction heater 54.

The power supply device 56 is operatively coupled to the induction heater 54. The power supply device 56 functions as an electrical source to drive alternating current through the induction heater 54 and the tube 58 of the induction heater 54. The passage of the current through the electrically conductive tube 58 generates a magnetic field in the induction heating path that causes eddy currents to flow through the item 12. The alternating magnetic field in the tube 58 repeatedly alters the eddy current flow in the item 12 causing friction and heating of the item 12. The amount of current supplied to the induction heater 54 from the power supply device may be varied. As a result, the output power and/or the output frequency of the induction heater 54 is also varied.

Optionally, the induction heating station 38 may include a microprocessor (not shown) that controls the current supplied to the induction heater 54 and thus the voltage applied to the item 12. As a result, the speed at which the item 12 heats is controllable. The induction heating station 38 may also include a temperature or reflectivity probe (not shown) that provides feedback to help regulate heating of the item 12.

Figure 3:
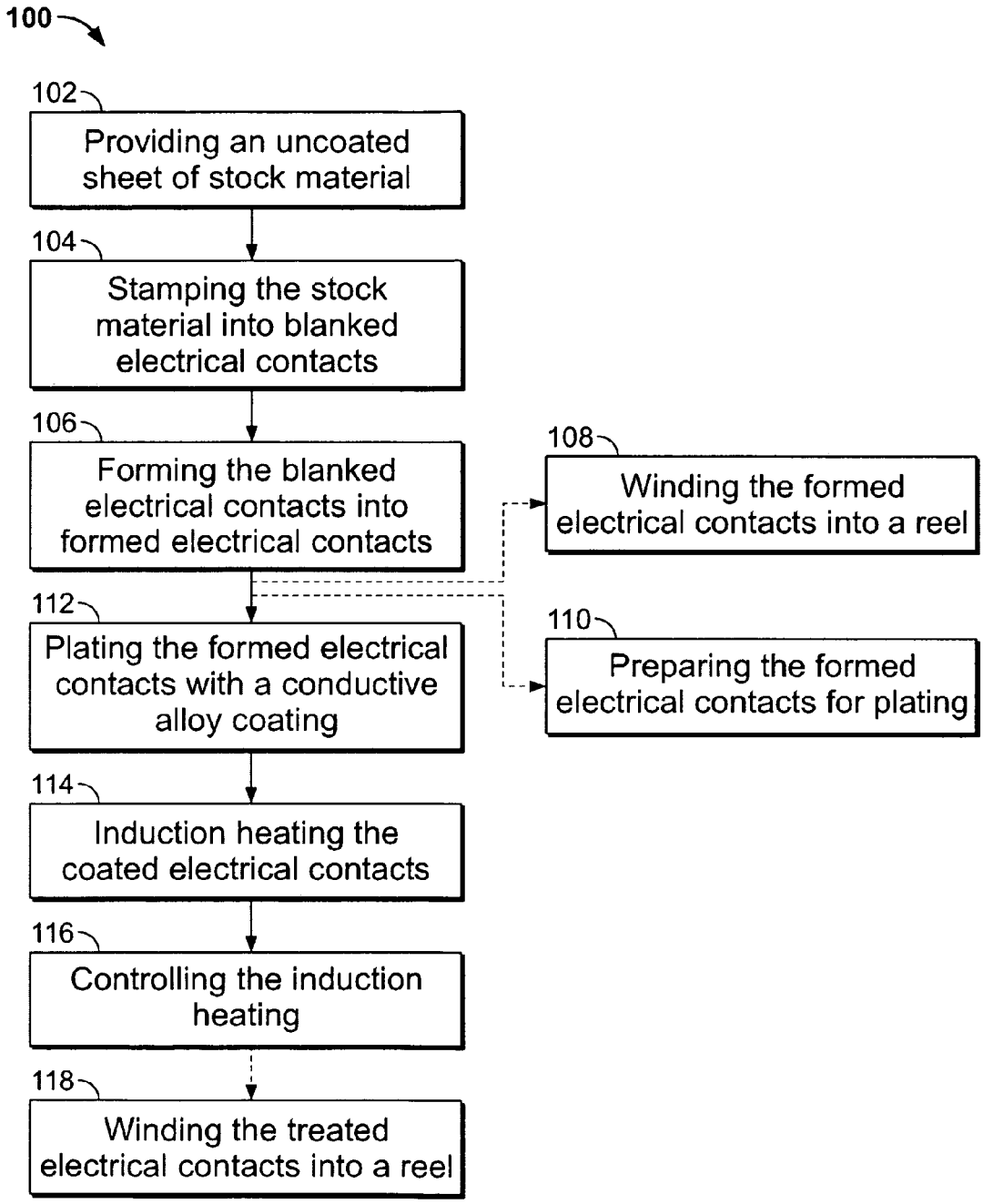
FIG. 3 is a flow chart illustrating an exemplary method of manufacture using the machine shown in FIG. 1.

FIG. 3 is a flow chart illustrating an exemplary method of manufacture 100 using the machine 10 shown in FIG. 1. The method includes providing 102 an uncoated sheet of stock material. The sheet of stock material is generally a planar body of a conductive material having predefined width, length and thickness dimensions.

The sheet of stock material is then stamped 104 or cut into a blank of electrical contacts having body portions extending between a tip and a base. The stock material is stamped 104 at a stamping station to form blanked electrical contacts. The body portions of the blanked electrical contacts are defined by removing sections of the stock material between each body portion. The amount of material removed, and thus the size of the body portions corresponds to a desired end-usable product. The blank, and more particularly the bases, are interconnected to one another along a carrier strip. As a result, each blanked electrical contact is interconnected to one another and the blanked electrical contacts may be continuously conveyed or feed through the various manufacturing stations.

The blanked electrical contacts are then conveyed to a forming station where the blanked electrical contacts are formed 106. When the electrical contacts are formed 106, the formed electrical contacts have a predetermined shape. For example, the formed electrical contacts may be curved or flexed into a non-planar pattern having a shape substantially similar to the end-usable product. Optionally, the forming 106 process may involve a pressing process using dies and a pressing machine to provide the curved or flexed pattern. Alternatively, the forming 106 process may involve a crimping process.

The formed electrical contacts are then conveyed or otherwise provided to a plating station and then an induction heating station. Further shaping and forming is not required after the formed electrical contacts are provided to the plating station and the induction heating station. The formed electrical contacts may be wound 108 onto a reel prior to being conveyed to the plating station. Optionally, the formed electrical contacts are wound 108 onto a reel after being conveyed to the plating station, but before being conveyed to the induction heating station. Alternatively, the formed electrical contacts may be conveyed directly from the forming station to the plating station and then to the induction heating station. Prior to providing the formed electrical contacts at the plating station, an optional processing step involves preparing 110 the formed electrical contacts for plating through a washing or rinsing process.

At the plating station, the formed electrical contacts are plated 112 with a conductive alloy coating. The contacts may be plated 112 through a dipping process or a spraying process. Optionally, the formed electrical contacts are selectively plated 112 in pre-selected areas, such as predetermined soldering or contact areas of the electrical contact. The coated electrical contacts are then transferred to the induction heating station.

At the induction heating station, the coated electrical contacts are induction heated 114 using an induction heater such as the induction heater 54 shown in FIG. 2. The induction heating 114 causes the conductive alloy coating to reflow, thus relieving internal stresses in the coating. As a result, the risk of whisker growth in the coating during soldering of the end-usable product 16 is substantially reduced. Optionally, the induction heating is controlled 116 by a controller, such as a microprocessor. The induction heating may be controlled 116 by adjusting the operating power of the induction heater 54. The induction heating may also be controlled 116 by adjusting the operating frequency of the induction heater. The induction heating may also be controlled 116 by adjusting the shape of the induction heater coil 58 or the proximity of the contacts to the coil 58. The induction heating may also be controlled 116 by adjusting the speed which the coated electrical contacts are transferred through the induction heater 54, or by adjusting the amount of time the coated electrical contacts are positioned in proximity to the induction heater 54. As such, the temperature of the coated electrical contacts may be controlled, or the reflow process of the coating on the electrical contacts may be controlled. After induction heating 114 the coated electrical contacts, the electrical contacts may be wound 118 onto a reel for transporting or storing the shaped, coated and treated electrical contacts.

Figure 5:
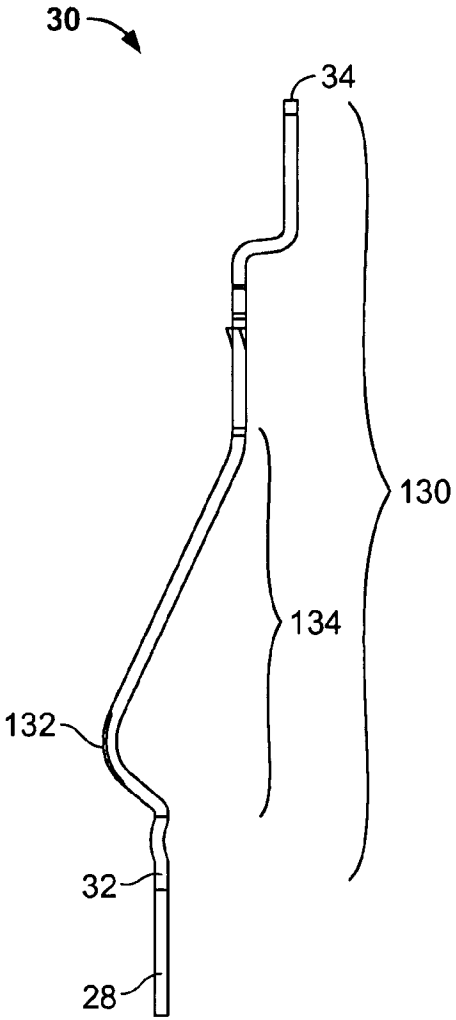
FIG. 5 is a side view of the formed electrical contact shown in FIG. 4.
Figure 4:
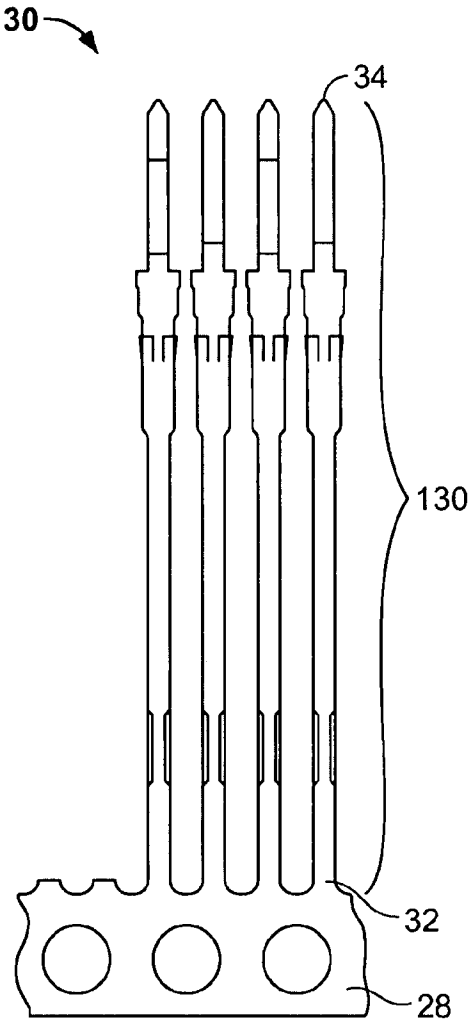
FIG. 4 is a top view of a formed electrical contact manufactured using the machine shown in FIG. 1.

FIGS. 4 and 5 are top and side views of the formed electrical contact 30 manufactured using the machine 10 shown in FIG. 1. FIG. 4 illustrates a plurality of the formed electrical contacts 30 on the carrier strip 28. Each formed electrical contact extends between the base 32 and the tip 34. As illustrated in FIG. 5, the formed electrical contact 30 includes a body portion 130 having a series of bends 132 and arcuate sections 134. The formed electrical contact 30 may have any shape depending on the particular end-usable product 16 desired, and the formed electrical contact 30 is provided as an illustration only. Once the formed electrical contact 30 has the desired shape, e.g. a shape substantially similar to the shape of the end-usable product 16, the electrical contact 30 may be transferred to the plating station 36 and the induction heating station 38.

While the invention has been described in terms of various specific embodiments, those skilled in the art will recognize that the invention can be practiced with modification within the spirit and scope of the claims.

What is claimed is:

1. A method for manufacturing an electrical contact, the method comprising:

providing blanked electrical contacts;

forming the blanked electrical contacts into formed electrical contacts joined on a carrier strip, wherein the formed electrical contacts have a shape configured for end use;

providing the formed electrical contacts to a plating station followed by an induction heating station;

at the plating station, plating the formed electrical contacts with a conductive alloy coating to form coated electrical contacts; and at the induction heating station, induction heating the coated electrical contacts.

2. The method of claim 1, further comprising stamping a sheet stock into blanked electrical contacts joined on a carrier strip, wherein the stamping comprises removing a portion of the stock.

3. The method of claim 1, wherein said forming comprises forming the blanked electrical contacts into formed electrical contacts having a base configured to be soldered to a substrate, and wherein said plating comprises plating at least a portion of the base after the base has an end use shape configured for soldering to the substrate.

4. The method of claim 1, wherein the forming comprises forming the blanked electrical contacts into formed electrical contacts, each formed electrical contact having a non-planar contact body extending between a tip and a base.

5. The method of claim 1, wherein the plating comprises selectively plating portions of the electrical contacts with one of a tin and a tin alloy.

6. The method of claim 1, wherein the providing a series of electrical contacts comprises one of continuously providing the electrical contacts to the plating station and the induction heating station and providing the electrical contacts to the plating station and the induction beating station in batches.

7. The method of claim 1, wherein the providing a series of electrical contacts comprises providing the series of electrical contacts on a reel, the method further comprising after induction heating the coated electrical contacts, winding the coated electrical contacts onto a second reel.

8. The method of claim 1, further comprising controlling the temperature of the coated electrical contacts at the induction heating station by adjusting the speed which the coated electrical contacts are provided to the induction heating station.

9. The method of claim 1, further comprising:

providing an induction heater at the induction heating station wherein the induction heater has an operating frequency and an operating power; and controlling the temperature of the coated electrical contacts at the induction heating station by adjusting one of the operating frequency and the operating power.

10. The method of claim 1, further comprising:

providing an induction heater at the induction heating station; and guiding the coated electrical contacts through the induction heater to maintain a spacing between the electrical contacts and the induction heater.

11. A method of preparing an electrical contact for induction heating, the method comprising:

providing a series of blanked electrical contacts joined on a carrier strip to a forming station followed by a plating station;

at the forming station, forming the blanked electrical contacts into formed electrical contacts joined on a carrier strip, wherein the formed electrical contacts have a shape configured for end use; and at the plating station, plating the formed electrical contacts with a conductive alloy coating to form coated electrical contacts.

12. The method of claim 11, wherein the providing comprises stamping a sheet stock into blanked electrical contacts joined on a carrier strip, wherein the stamping comprises removing a portion of the stock.

13. The method of claim 11, wherein the forming comprises crimping the blanked electrical contacts into a predetermined shape.

14. The method of claim 11, wherein the forming comprises forming the blanked electrical contacts into formed electrical contacts, each formed electrical contact having a non-planar contact body extending between a tip and a base, each base being interconnected by the carrier strip.

15. The method of claim 11, wherein the plating comprises selectively plating portions of the electrical contacts.

16. The method of claim 11, wherein the providing comprises one of continuously providing the electrical contacts to the forming station and the plating station and providing the electrical contacts to the forming station and the plating station in batches.

17. The method of claim 11, further comprising:

after forming the electrical contacts, winding the formed electrical contacts onto a reel; and providing the reel of formed electrical contacts to the plating station.

18. The method of claim 11, further comprising, after plating the electrical contacts at the plating station, providing the coated electrical contacts to an induction heating station, wherein the coated electrical contacts are treated to facilitate reducing tin whisker growth.

* * * * *